US007510017B2

(12) United States Patent
Howell et al.

(10) Patent No.: US 7,510,017 B2
(45) Date of Patent: Mar. 31, 2009

(54) SEALING AND COMMUNICATING IN WELLS

(75) Inventors: Matt Howell, Duncan, OK (US); James C. Tucker, Springer, OK (US); Mike Connell, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 253 days.

(21) Appl. No.: 11/595,539

(22) Filed: Nov. 9, 2006

(65) Prior Publication Data

US 2008/0110644 A1 May 15, 2008

(51) Int. Cl.
*E21B 33/12* (2006.01)
*E21B 43/11* (2006.01)

(52) U.S. Cl. ..... 166/387; 166/65.1; 166/118; 166/297

(58) Field of Classification Search ..... 166/381, 166/382, 387, 385, 65.1, 66, 118, 123, 138, 166/196, 331, 272.2, 271, 297, 298, 308.1, 166/55, 177.5
See application file for complete search history.

(56) References Cited

U.S. PATENT DOCUMENTS 4,441,561 A * 4/1984 Garmong ..... 166/387
4,699,216 A * 10/1987 Rankin ..... 166/385
4,962,815 A 10/1990 Schultz et al.
5,094,294 A 3/1992 Bayh, III
5,435,395 A 7/1995 Connell
5,456,322 A 10/1995 Tucker et al.
5,485,745 A 1/1996 Rademaker et al.
5,626,192 A 5/1997 Connell et al.
5,704,393 A 1/1998 Connell et al.
5,762,142 A 6/1998 Connell et al.
5,832,998 A 11/1998 Decker et al.
5,845,711 A 12/1998 Connell et al.
6,196,325 B1 3/2001 Connell et al.
6,202,747 B1 3/2001 Lacy et al.
6,220,362 B1 4/2001 Roth et al.
6,253,842 B1 7/2001 Connell et al.
6,305,467 B1 10/2001 Connell et al.
6,394,184 B2 * 5/2002 Tolman et al. ..... 166/281
6,474,419 B2 11/2002 Maier et al.

(Continued)

OTHER PUBLICATIONS

Website: Halliburton Retrievable Tools Books and Catalogs: Cobra FracSM RR4-EV Packer, http://www.halliburton.com/public/tttcp/contents/Books_and _Catalogs/web/ServiceTools/Retrievable_CobraFracPacker.pdf, Mar. 2006, 2 pages.

(Continued)

*Primary Examiner*—Kenneth Thompson
(74) *Attorney, Agent, or Firm*—John W. Wustenberg; Fish & Richardson P.C.

(57) ABSTRACT

A device includes a main body adapted to couple between a first element of a working string and a second element of the working string. A seal is provided about the main body and is adapted to substantially sealingly engage a wall of the wellbore. An conductor is carried by the main body. The conductor is adapted to communicate at least one of electrical current or a light signal between an interior of the first element and the second element while the seal is substantially sealingly engaging the wall of the wellbore, while the device is released from sealingly engaging the wall of the wellbore, and/or both.

25 Claims, 8 Drawing Sheets

U.S. PATENT DOCUMENTS

| | | | |
|---|---|---|---|
| 6,543,538 | B2 | 4/2003 | Tolman et al. |
| 6,561,278 | B2 | 5/2003 | Restarick et al. |
| 6,688,389 | B2 | 2/2004 | Connell et al. |
| 6,766,853 | B2 | 7/2004 | Restarick et al. |
| 7,036,602 | B2 | 5/2006 | Turley et al. |
| 7,073,582 | B2 | 7/2006 | Connell et al. |
| 2005/0167094 | A1 | 8/2005 | Streich et al. |
| 2005/0173126 | A1 | 8/2005 | Starr et al. |
| 2005/0189103 | A1 | 9/2005 | Roberts et al. |
| 2006/0042792 | A1 | 3/2006 | Connell |

OTHER PUBLICATIONS

Website: Kemlon Products and Development: Single Pin Booted Electrical Feedthru Connectors, http://www.kemlon.com/catalogs/duoseel/duoseel.htm, copyright 1999, printed May 25, 2006, 3 pages.

* cited by examiner

SEALING AND COMMUNICATING IN WELLS

BACKGROUND

The present disclosure relates to wells and operations performed in wells.

In many well operations, power and/or signals are communicated through the working string between the surface and elements of the working string and from element to element of the working string. For example, an electrical conductor, such as an e-line, can pass through the interior of the working string to communicate electrical current. In some instances, the electrical current provides power to the elements of the working string. The electrical current may additionally, or alternatively, operate as a signal communicating between the surface and the working string element and/or between elements of the working string. For example, the electrical current may provide power to a downhole tool, as well as a signal to actuate the tool. In another example, a downhole sensor may communicate data to the surface in the form of electrical current. Although electrical current is a common form for communications downhole, communications can take other forms, such as by light over a fiber optic line.

Due to the increasing prevalence of downhole tools that operate, at least in part, on power and/or signals communicated through the working string (versus, solely by mechanical manipulation of the tool) there is a need for additional downhole tools to facilitate this communication.

SUMMARY

The present disclosure relates to wells and operations performed in wells. The disclosure encompasses systems and methods for communicating between two elements of a working string, as well as isolating lengths of the wellbore.

One aspect encompasses a device for inserting in a wellbore. The device includes a main body adapted to couple between a first element of the working string and a second element of the working string. A seal is provided about the main body and is adapted to substantially sealingly engage a wall of the wellbore. A conductor is carried by the main body. The conductor is adapted to communicate a signal and/or power between an interior of the first element and the second element. In some instances, the conductor may communicate the signal and/or power while the seal is substantially sealingly engaging the wall of the wellbore, while the device is released from sealingly engaging the wall of the wellbore, and/or both. In some instances, the conductor communicates electrical current. In other instance, the conductor can carry other forms of signals and/or power, such as light, acoustic, or other energy forms.

Another aspect encompasses a method of wellbore operations. In the method, a first portion of a wellbore is substantially isolated from pressure in a second portion of the wellbore using the working string. At least one of an electrical current or a light signal is communicated between an interior of a first element of the working string and a second element of the working string. The first element resides in the first portion of the wellbore and the second element resides in the second portion of the wellbore.

Another aspect encompasses a method in which a working string is positioned in a wellbore. An annulus between the working string and the wellbore is substantially sealed. At least one of an electrical current or a light signal is communicated through the working string between a location above the location of sealing and a location below the location of sealing.

One or more of the implementations described herein enable power and/or signals, for example electrical current or light signals, to occur between elements of a working string residing in disparate isolated zones along a length of a wellbore. Thus, an element of the working string can be provided in one zone and isolated from operations in the other zone. For example, in a perforating and fracturing context, the perforating tool and sensors may be provided in a zone of the wellbore that is isolated from the zone subjected to the high pressure fracturing fluids.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
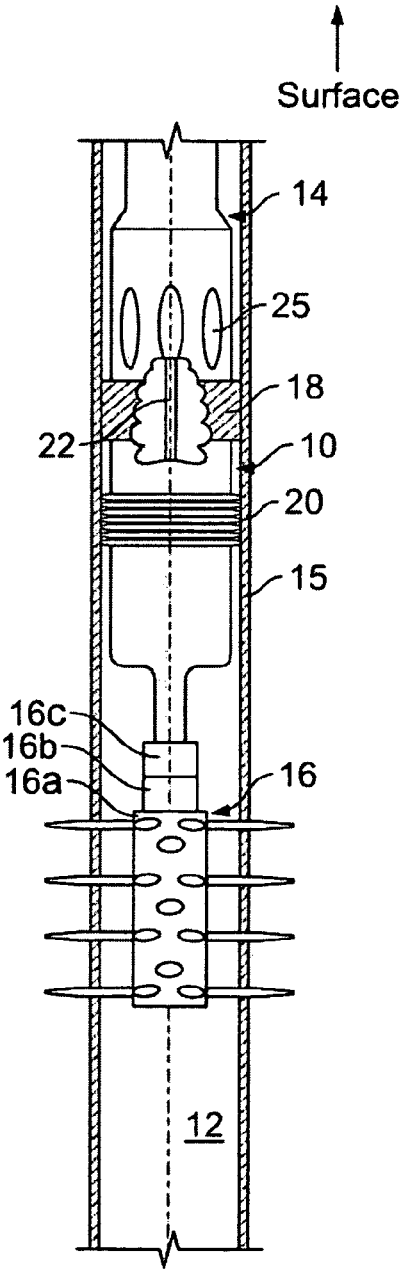
FIG. 1A is a schematic side view of a working string, including a conductor seal system, perforating a wellbore in accordance with the concepts described herein.

Referring first to FIG. 1A, an illustrative conductor seal system 10 is shown residing in a subsurface wellbore 12. In general terms, the conductor seal system 10 is a device or tool actuable to isolate a portion, or zone, of the wellbore 12 from another portion, or zone, of the wellbore 12, as well as communicate power and/or a signal with one or more devices or tools (e.g., one or more downhole tools 16) in the wellbore 12. FIG. 1A depicts the illustrative conductor seal system 10 conveyed as part of a working string 14. The power and/or signal is communicated through the interior of the working string 14, and through the interior of the illustrative conductor seal system 10 on a conductor 22. In some instances, the power is in the form of electric current. The electric current may power one or more of the downhole tools 16. Additionally, or alternatively, the electric current may be an electric signal or communication (e.g., a signal used in actuating/deactuating a tool, a data stream to and/or from a tool, or other communication). The conductor 22 can be a single conductor or can be multiple conductors capable of transmitting multiple electrical currents in parallel. In other embodiments, the conductor seal system 10 can incorporate fiber optics, in addition to or as an alternative to the electric conductors, for conducting light signals to the one or more devices. In certain embodiments, the power and/or the signal can be communicated in other manners, such as acoustically, thermally, or otherwise. Also, the power and/or signal need not be communicated entirely by the same manner, i.e. the power and/or signal need not be communicated entirely electrically.

The working string 14 extends from the surface and includes the illustrative conductor seal system 10 and the downhole tools 16. The remainder of working string 14 may be made up of one or more additional elements. The elements can include, for example, interconnected lengths of tubing, continuous or substantially continuous coiled tubing and other downhole tools. In some instances, in some instances the entire working string may be coiled tubing. Lengths of wireline, other tubulars, or other devices that are not part of the working string 14 may reside alongside of, and in some cases even be affixed to, the exterior of the working string 14.

The illustrative conductor seal system 10 includes a seal 18. The seal 18 is actuable to sealingly engage a wall of the wellbore 12 and substantially prevent flow through the annulus between the conductor seal system 10 and the wall of the wellbore 12. In some instances, the wall of the wellbore 12 may include a casing 15. When the seal 18 is in sealing engagement with the wall of the wellbore 12, no substantial flow may pass from above the seal 18 to below the seal 18. In other words, the zone downhole from the seal 18 is isolated from pressure in the zone up-hole from the seal 18. When the seal 18 is not actuated (i.e. de-actuated) to seal the annulus, flow may pass through the annulus. In certain embodiments, the seal 18 may be actuated and de-actuated at least in part mechanically by manipulation of the working string. In other embodiments, the seal 18 may be actuated/de-actuated in a different manner. For example, the seal 18 may be actuated/de-actuated by being fluid inflated, by using a hydraulic piston and cylinder arrangement, by using motors or linear actuators, or by another manner. In some instances, the seal 18 may be adapted to be actuated and de-actuated multiple times. without withdrawing the conductor seal system 10 from the wellbore 12 (i.e. during the same trip). As described in more detail below, the ability to actuate and de-actuate multiple times during the same trip enables the conductor seal system 10 to be repeatedly operated to isolate the same or different zones in the wellbore 12. Although depicted in FIG. 1A with only one seal 18, the conductor seal system 10 may be provided with additional seals 18. If multiple seals 18 are provided, the seals 18 may be positioned together or spaced apart. In certain embodiments, the working string 14 can include additional sealing devices (not specifically shown), such as additional conductor seal systems, packers, bridge plugs, and other sealing devices. The additional sealing devices can operate apart from the conductor seal system 10 or cooperate with the conductor seal system 10 to isolate zones of the wellbore 12. In one instance, the isolated zone can be between the conductor seal system 10 and an additional sealing device.

Certain embodiments of the conductor seal system 10 can include a gripper 20 actuable to selectively engage and grip the wall of the wellbore 12. In other instances, the gripper 20 may be omitted. The gripper 20 is configured to at least partially support loads (e.g., from pressure, the weight of the working string 14, and other loads) applied to the conductor seal system 10. In certain embodiments, the gripper 20 is configured to support the entire pressure load that occurs when isolating portions of the wellbore, as well as the weight of the working string 14. In certain embodiments, the gripper 20 may be actuated and de-actuated at least in part mechanically by manipulation of the working string. In other embodiments, the gripper 20 may be actuated/de-actuated in a different manner. For example, the gripper 20 may be actuated/de-actuated by using a hydraulic piston and cylinder arrangement, by using motors or linear actuators, or by another manner.

Figure 1B:
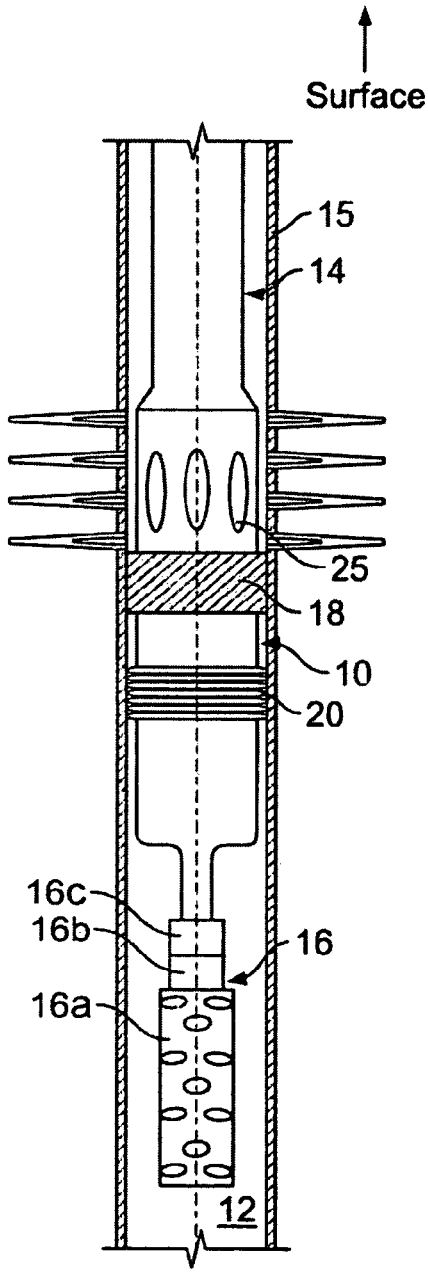
FIG. 1B is a schematic side view of the working string of FIG. 1A fracturing a wellbore in accordance with the concepts described herein.

FIG. 1A depicts the illustrative conductor seal system 10 in a working string 14 configured for perforating and fracturing operations. Hence, the downhole tools 16 include a perforation gun 16*a*, a collar locator 16*b* and a pressure sensor sub 16*c*. The perforating gun 16*a* is configured to perforate a wall of the wellbore 12. The collar locator 16*b* is configured to track the position of the working string 14 relative to the wellbore 12, so that the position of the working string can be determined. The pressure sensor sub 16*c* is configured to sense the pressure in the wellbore about the working string 14. FIG. 1A depicts the illustrative conductor seal system 10 with the seal 18 sealingly engaging the wellbore 12 and the perforating gun 16*a* perforating the wall of the wellbore 12. FIG. 1B depicts the illustrative conductor seal system 10 fracturing a formation about the wellbore 12. In FIG. 1B the working string 14 has been repositioned along a length of the wellbore 12 with the seal 18 sealingly engaging the wellbore 12 downhole from the perforations, and fracturing fluid is introduced up-hole of the seal 18.

It is within the scope of the concepts described herein for the conductor seal system 10 to be used in a working string 14 configured for additional or different operations. Some examples of different operations the conductor seal system 10 can be configured for include, perforating operations apart from fracturing, measuring pressure well pressure below the seal 18, well testing, well inspection, well logging, well workover, well intervention and other operations. Likewise, the downhole tools 16 may encompass additional or different tools. Some examples of different downhole tools 16 include, one or more sensors, cameras, logging tools (e.g. acoustic, gamma, neutron, gyroscopic, magnetic and/or other types), packers, and other downhole tools.

Figure 2A:
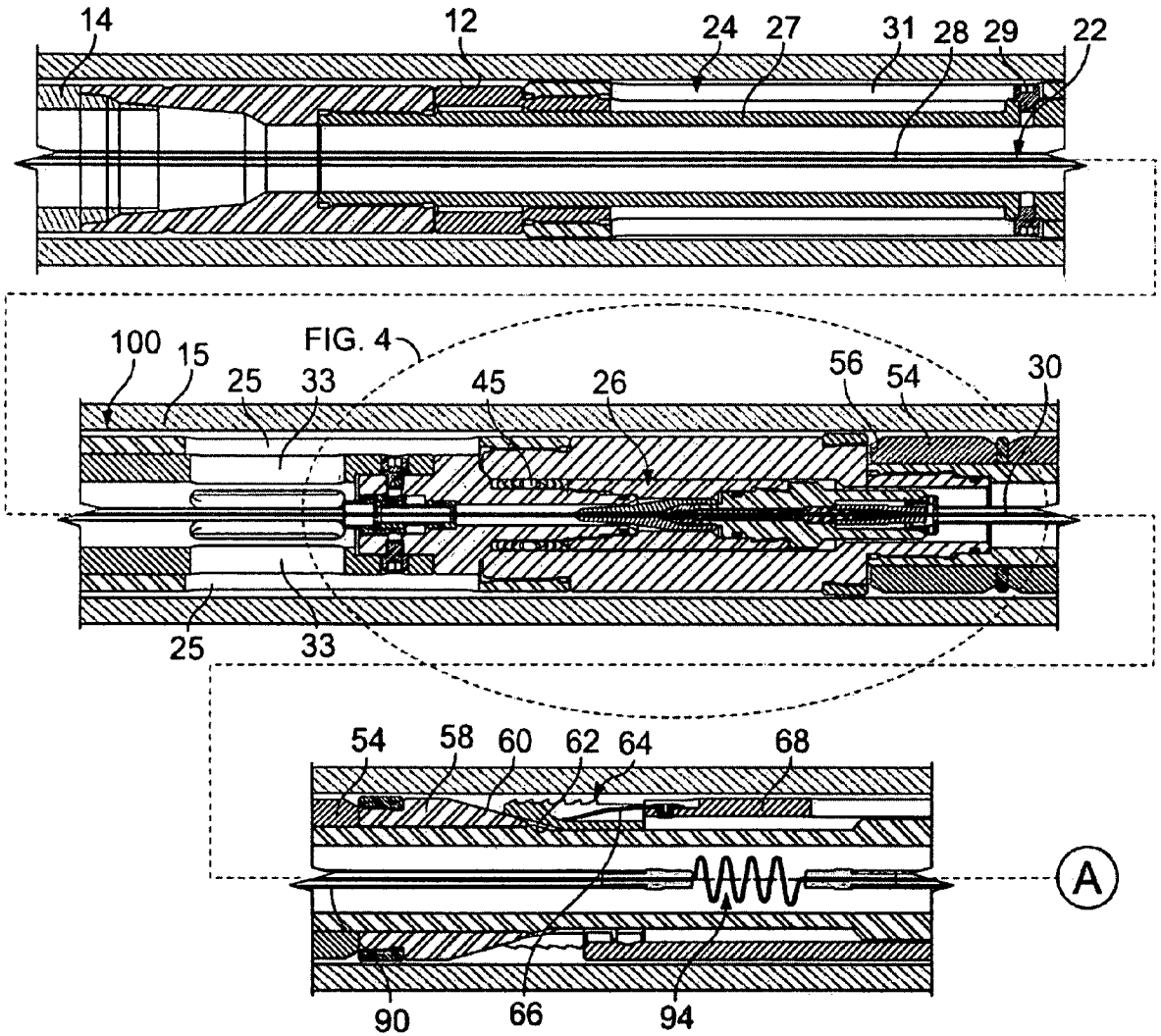
FIGS. 2A and 2B are a cross sectional side view of an illustrative conductor seal system in accordance with the concepts described herein.
Figure 2B:
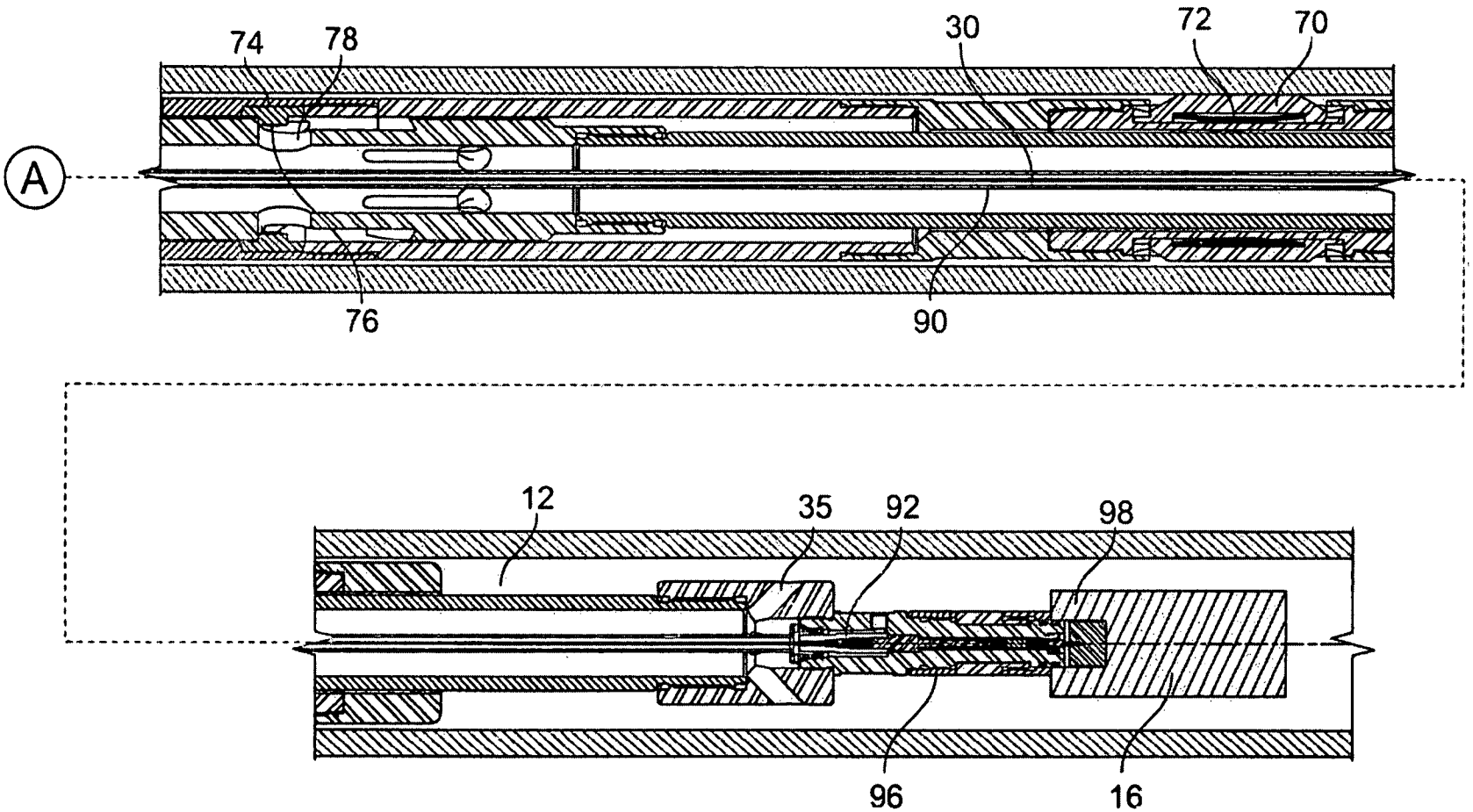

Referring now to FIGS. 2A and 2B, another illustrative conductor seal system 100 is depicted in cross-section. The conductor seal system 100 includes a tubular main body 24 that extends the length of the conductor seal system 100. The main body 24 is adapted to couple between other elements of the working string 14. In certain embodiments, the working string 14 above the main body 24 is tubular and can communicate fluids from the surface into the interior of the main body 24. The main body 24 may then be provided with radially oriented ports 25. The ports 25 are adapted to communicate fluids, such as fracturing fluids, from the interior of the main body 24 into the annulus between the conductor seal system 100 and the wellbore 12. In other embodiments, the main body 24 can be provided without ports 25. If no ports 25 are provided, fracturing can be performed by introducing fracturing fluids from another element of the working string 14. Fluids can also, or alternatively, be communicated from the surface through the annulus between the wall of the wellbore 12 and the working string 14.

Figure 3A:
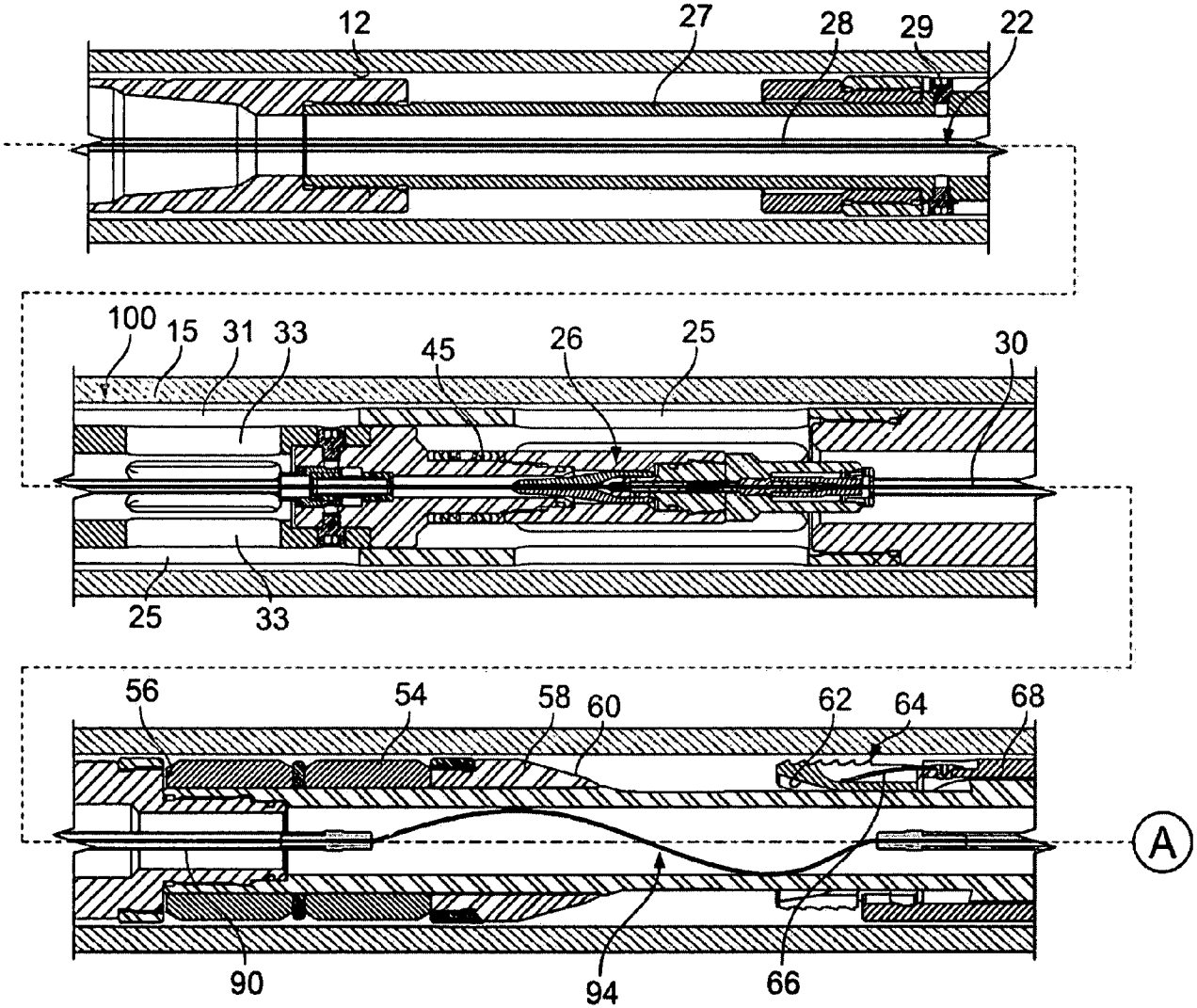
FIGS. 3A and 3B are a cross sectional side view of the illustrative conductor seal system of FIGS. 2A and 2B extended.

The illustrative conductor seal system 100 includes a tubular inner body 27 telescopically received in an upper portion of the main body 24. The inner body 27 is coupled to the working string 14, and may be partially withdrawn from the main body 24 as shown in FIG. 3A. Guide lugs 29 on the inner body 27 are received in and cooperate with elongate receptacles 31 on the main body 24 to guide the inner body 27, limiting the extent of travel and preventing rotation of the inner body 27, relative to the main body 24. In instances where the main body 24 includes ports 25, the inner body 27 may also include ports 33. The ports 33 are located to coincide with the ports 25 when the inner body 27 is fully received within the main body 24 as in FIG. 2A.

The working string 14 above the main body 24 internally carries a conductor 28, for example a wireline, e-line, or other type of conductor (e.g., fiber optic), from the surface, from another element of the working string 14 or from a downhole source, such as a battery, power supply, controller input/output or other source (not specifically shown). The main body 24 includes an internal conductor 22 that connects with the conductor 28. The conductor 22 communicates between the conductor 28 and the one or more downhole tools 16. In the configuration of FIGS. 2A and 2B, the conductor 22 communicates electrical current, although other embodiments may communicate power and/or signals in another form (e.g. light signals). In certain embodiments, the communication is only one way, i.e. from the conductor 28 to the one or more downhole tools 16 or from the one or more downhole tools 16 to the conductor 28. In other embodiments, the communication is both ways.

In the configuration of FIGS. 2A and 2B, the internal conductor 22 includes an upper connector 26 that connects with the conductor 28, a lower connector 92, and an intermediate conductor 30 spanning between the upper connector 26 and lower connector 92. In other embodiments, the internal conductor 22 can include fewer or additional components. The upper connector 26 is carried on the inner body 27. The lower connector 92 couples to a connector 98 internally carried in the downhole tool 16. The conductor 28 and internal conductor 22 cooperate to communicate from an interior of an element of the working string 14 above the conductor seal system 100, through the interior of the conductor seal system 100, to the interior of an element of the working string 14 (e.g., downhole tool 16) below the conductor seal system 100.

Figure 3B:
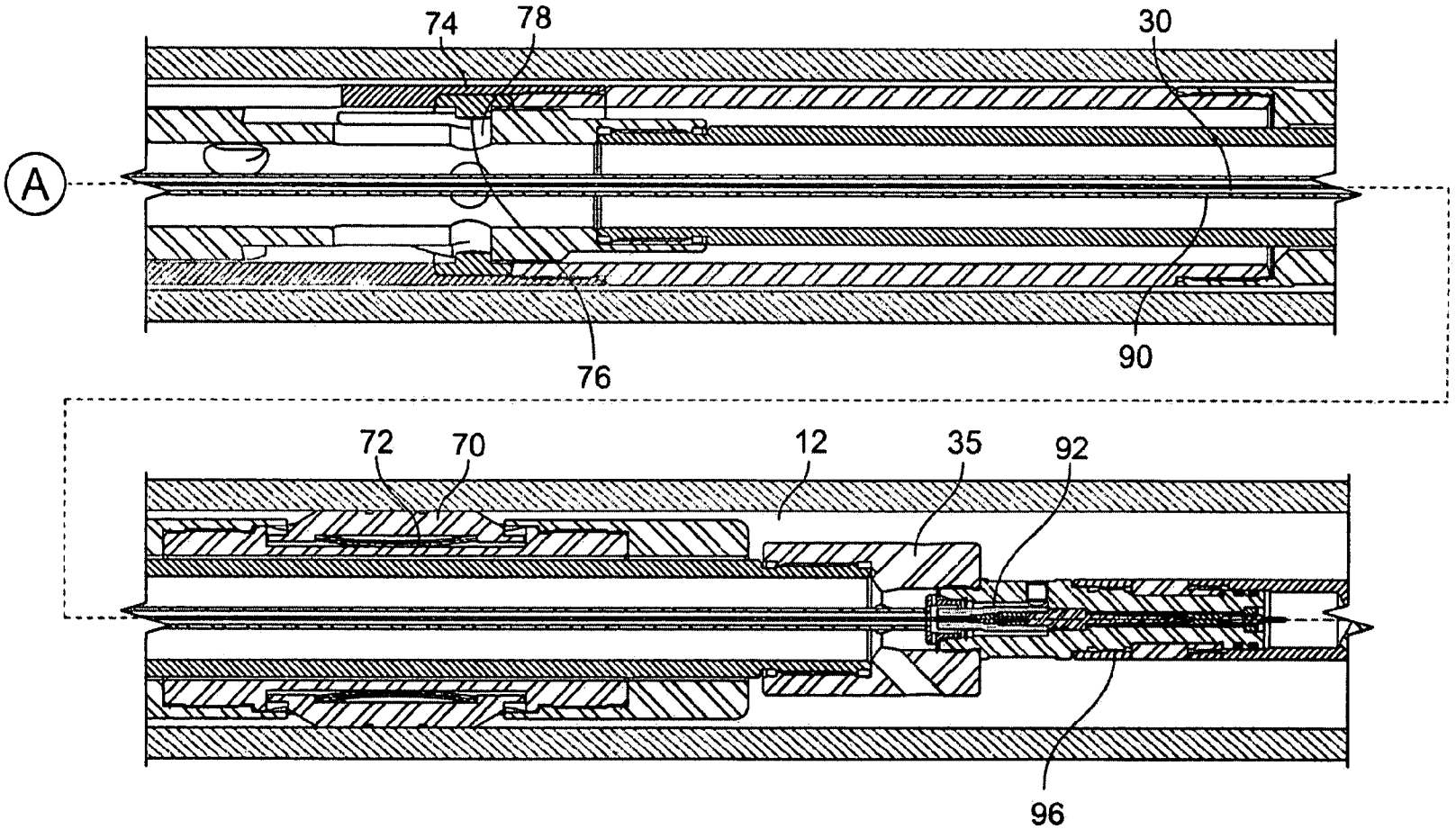
Figure 4:
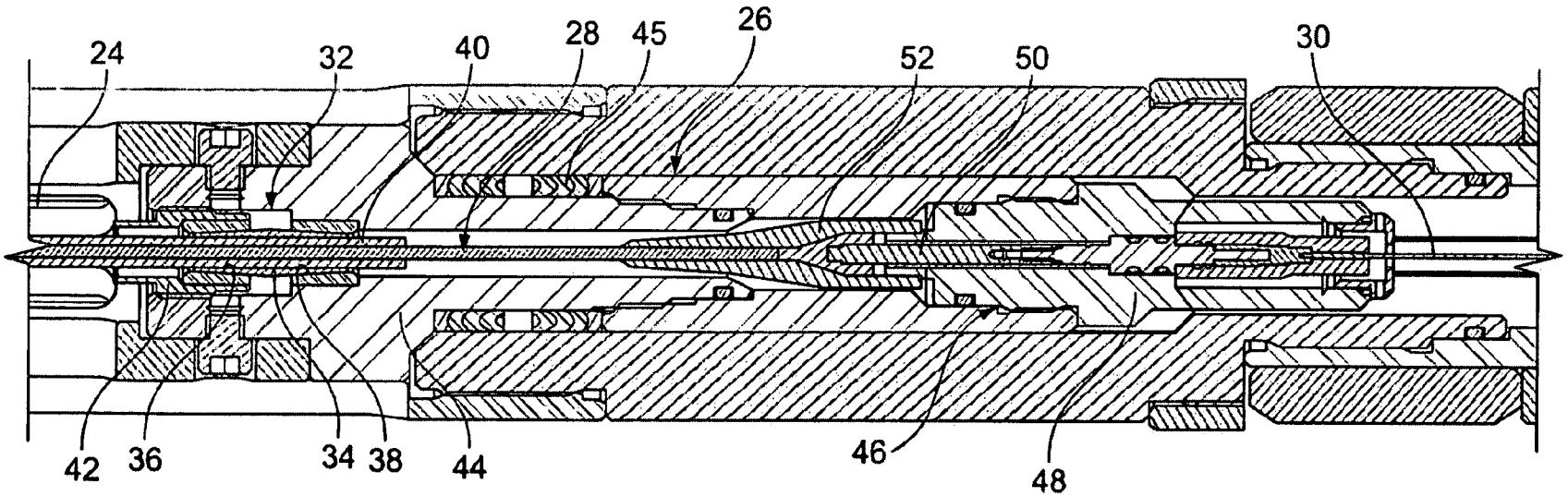
FIG. 4 is a detail cross-sectional side view about an upper connector of the illustrative conductor seal system of FIGS. 2A and 2B.

FIG. 4 depicts, in detail, upper connector 26 used in the embodiment of FIGS. 2A and 2B. The upper connector 26 includes an anchor 32 that grips the conductor 28 and anchors the conductor 28 relative to the upper connector 26. The anchor 32 has a tubular sleeve 34 that internally receives the conductor 28. If the conductor 28 is provided with armor 40, the tubular sleeve 34 may receive the armor 40 as well. The tubular sleeve 34 is captured between two opposing inwardly tapered collars 36 and 38. Inwardly tapered collar 36 is carried in a threaded anchor body 42 that is threadingly received in a housing 44 of the anchor 32. The housing 44 is substantially sealed to the main body 24, so that flow from the interior of the main body 24 above the upper connector 26 is directed into the out of ports 25. In one instance, chevron seals 45 provide the seal. When inner body 24 is extended from the main body 24 (FIGS. 3A and 3B), the chevron seals 45 are withdrawn from sealing against the main body 24, and thus allow flow through the interior of the main body 24 to pass beyond the upper connector 26 and out ports 35. Threading the threaded anchor body 42 into the housing 44 of the anchor 32 brings the inwardly tapered collar 36 toward the inwardly tapered collar 38. As they converge, the inwardly tapered collars 36, 38 radially compress the tubular sleeve 34 into gripping engagement with the exterior of the conductor 28 and anchor the conductor 28 to the upper connector 26.

From the anchor 32, the conductor 28 extends to a sealed electrical terminal 46. In one instance, for example, the sealed electrical terminal 46 is a single pin booted electrical feed through connector, model K-31 manufactured by Kemlon Products. In other instances, different brand and/or models of connectors can be used or the connector can be custom. In FIG. 4, the sealed electrical terminal 46 includes a connector body 48 that threadingly couples to and substantially seals with the housing 44 of the upper connector 26. The seal between the sealed electrical terminal 46 and housing 44 cooperates with the seal between the housing 44 and the main body 24 to seal against passage of fluid from the interior of the main body 24 beyond the upper connector 26.

A conductor shaft 50 is coupled to the conductor and extends through the interior of the connector body 48. The conductor shaft 50 is electrically insulated from the remainder of the connector body 48, so that the electrical current carried by the conductor shaft 50 is not transmitted to the remainder of the conductor seal system 100. A sealing boot 52 is received over the end of the connector body 48 and substantially seals to the connector body 48 and the conductor 28 to prevent fluid flow into the interior of the sealed electrical terminal 46. The conductor shaft 50 is also coupled to the intermediate conductor 30 to communicate the electrical current or signal received from the conductor 28 to the intermediate conductor 30. The intermediate conductor 30 can be a wire, such as wireline, e-line or a solid conductor, or other conductor. A conduit 90 is coupled to the end of the sealed electrical terminal 46 and houses the intermediate conductor 30.

Referring back to FIGS. 2A and 2B, the conduit 90 and intermediate conductor 30 extend through the interior of the main body 24 to a lower connector 92. In certain embodiments, the conduit 90 may have a break 94 and additional intermediate conductor 30 may be provided to allow extension of the inner body 27. As above, the lower connector 92 is insulated, so that the electrical current carried therein is not transmitted to the remainder of the conductor seal system 100. The lower connector 92 is received in a connector stub 96 that extends from the bottom of the main body 24. The connector stub 96 is adapted to engage and connect the downhole tool 16 to the conductor seal system 100. The lower connector 92 is adapted to interface with the downhole tool 16 and provide the electric current or signal to the downhole tool 16. If multiple downhole tools 16 are provided (e.g., FIG. 1A perforating gun 16*a*, collar locator 16*b* and pressure sensor sub 16*c*), the lower connector 92 may communicate the electrical current to each of the downhole tools 16 separately, the downhole tools 16 may relay the electrical current from one to another, or the electric current may be communicated to the downhole tools 16 in another manner.

A packer seal 54 is received about the main body 24. FIGS. 2A and 2B show packer seal 54 as a multi-element seal having two elements. In other instances, the packer seal 54 can have fewer or additional elements. The packer seal 54 is captured between a shoulder 56 of the main body 24 and a seal drive ring 58. The seal drive ring 58 is received over the main body 24 and is configured to slide axially thereon. The seal drive ring 58 has a tapered wedge surface 60. The tapered wedge surface 60 abuts a tapered surface 62 of a slip assembly 64. The slip assembly 64 is configured such that when driven into the tapered wedge surface 60, the tapered wedge surface 60 and tapered surface 62 cooperate to force the slip assembly 64 radially outward into gripping engagement with the wall of the wellbore 12. If the wellbore 12 is provided with casing 15, the slip assembly 64 grips the casing. The slip assembly 64 is biased radially inward with springs 66.

The slip assembly 64 resides adjacent to a tubular carrier body 68 received over the main body 24. Like the seal drive ring 58, the carrier body 68 is configured to slide axially on the main body 24. The carrier body 68 also includes a plurality drag blocks 70 biased radially outward by springs 72. The drag blocks are configured to frictionally engage, i.e. drag, against the wall of the wellbore 12 as the conductor seal system 100 is moved.

When the conductor seal system 100 is moved downhole (to the right in FIGS. 2A and 2B) the drag blocks 70 tend to move the carrier body 68, and slip assembly 64, toward the tapered wedge surface 60 (to the left in FIGS. 2A and 2B). The downhole movement engages the slip assembly 64 with the tapered wedge surface 60 and drives the seal drive ring 58 to compresses the packer seal 54 against the shoulder 56. Compressing the packer seal 54 against shoulder 56 radially deforms the packer seal 54 into sealing engagement with the wall of the wellbore 12. Driving the slip assembly 64 into the tapered wedge surface 60 forces the slip assembly 64 radially outward into gripping engagement with the wall of the wellbore 12. When the conductor seal system 100 is moved up-hole, i.e. towards the surface, the drag blocks 70 tend to move the carrier body 68 away from the tapered wedge surface 60 (to the right in FIGS. 2A and 2B). If the slip assembly 64 and packer seal 54 are in engagement with the wall of the wellbore 12, the slip assembly 64 and packer seal 54 additionally tend to move the carrier body 68 away from the tapered wedge surface 60. As the carrier body 68 moves away from the tapered wedge surface 60, the slip assembly 64 and packer seal 54 disengage from the wall of the wellbore 12. Simply stated, moving the conductor seal system 100 downhole tends to engage the packer seal 54 and the slip assembly 64 with the wall of the wellbore 12. Moving the conductor seal system 100 up-hole tends to disengage the packer seal 54 and the slip assembly 64 from the wall of the wellbore 12.

The carrier body 68 includes a lug ring 74 with one or more inwardly extending lugs 76. The lug ring 74 is carried by the carrier body 68 so that it may rotate about the longitudinal axis of main body 24 and independent of the carrier body 68 itself. The lugs 76 are received in a J-slot slot 78 of the main body 24. The lugs 76 and J-slot slot 78 cooperate to regulate the actuation of the packer seal 54 and slip assembly 64, so that the slip assembly 64 and packer seal 54 can be set to engage or locked out from engaging the wellbore 12 on downhole movement of the conductor seal system 100.

Figure 5:
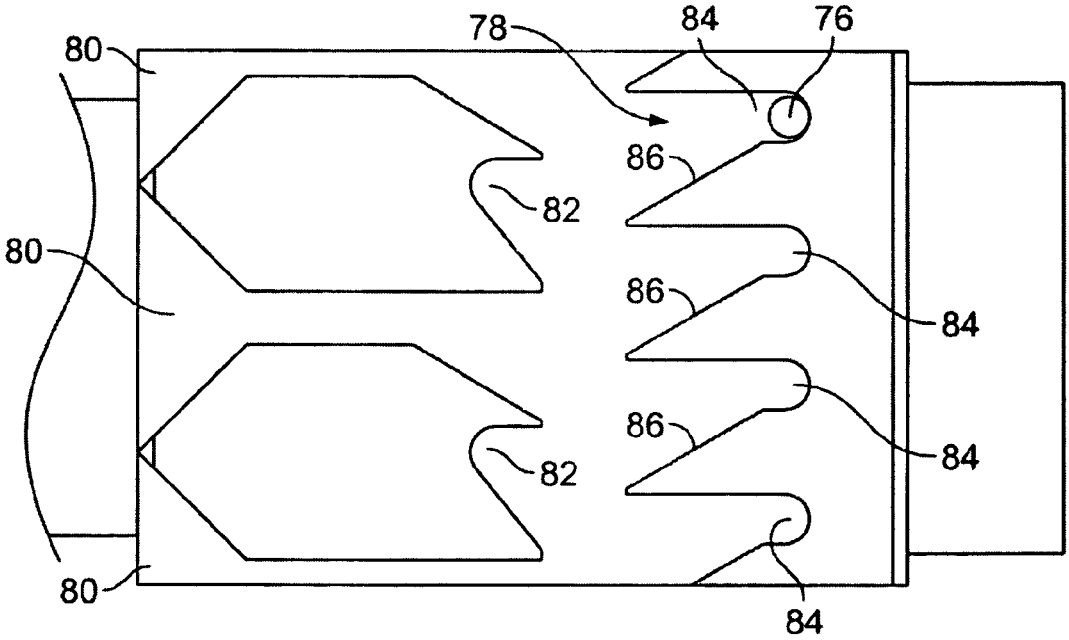
FIG. 5 is a detail cross-sectional side view about a J-slot slot of the illustrative conductor seal system of FIGS. 2A and 2B.

Referring to FIG. 5, the J-slot slot 78 is defined by one or more set receptacles 80, one or more lockout receptacles 82 and one or more indexing receptacles 84. The lug ring 74 rotates in the carrier body 68 to enable the lugs 76 to move alternately between the receptacles 80, 82 and 84. The number of receptacles in each flight of receptacles 80, 82 and 84 is equal to or greater than the number of lugs 76. With the lugs 76 received in the set receptacles 80, the slip assembly 64 and packer seal 54 can engage in the wall of the wellbore 12 as the conductor seal system 100 is moved downhole. With the lugs 76 received in the lockout receptacles 82, the slip assembly 64 and packer seal 54 are locked out of engagement with the wall of the wellbore 12. Thus, the slip assembly 64 and packer seal 54 cannot engage the wall of the wellbore as the conductor seal system 100 is moved downhole.

Moving the conductor seal system 100 up-hole, withdraws the lugs 76 from either the set receptacles 80 or the lockout receptacles 82 and moves the lugs 76 into the indexing receptacles 84. One or more of the indexing receptacles 84 include a guiding surface 86 that operates to guide a lug 76 exiting a set receptacle 80 into alignment with a lockout receptacle 82 and a lug 76 exiting the lockout receptacle 82 into alignment with a set receptacle 80. Thus, if the lugs 76 are received in lockout receptacles 82, the conductor seal system 100 can be moved downhole into position in the wellbore 12. Subsequently moving the conductor seal system 100 up-hole withdraws the lugs 76 from the lockout receptacles 82 and moves the lugs 76 into the indexing receptacles 84. The guiding surfaces 86 of the indexing receptacles 84 position the lugs 76 in alignment with respective set receptacles 80. Thereafter, moving the conductor seal system 100 downhole moves the lugs 76 into set receptacles 80. With the lugs 76 received in the set receptacles 80, the slip assembly 64 and packer seal 54 can engage the wall of the wellbore 12. Subsequently moving the conductor seal system 100 up-hole, moves the lugs 76 again into the indexing receptacles 84 in alignment under lockout receptacles 82. Thereafter, moving the conductor seal system 100 downhole moves the lugs 76 back into the lockout receptacles 82.

In operation, the conductor seal system 100 is initially configured with the lugs 76 received in the lockout receptacles 82. As such, the conductor seal system 100 is lowered into position within the wellbore 12 via the working string 14. Despite the drag blocks 70 frictionally engaging the wall of the wellbore 12, the conductor seal system 100 does not actuate to grip or seal with the wall of the wellbore 12. When in position, the main body 24 is pulled, via working string 14, in the up-hole direction to cause the lugs 76 to move into the indexing receptacles 84. The indexing receptacles 84 index the lugs 76 into alignment with the set receptacles 80. Thereafter, further movement of the conductor seal system 100 downhole sets the conductor seal system 100 by actuating the slip assembly 64 into gripping engagement and the packer seal 54 into substantially sealing engagement with the wall of the wellbore 12. In the set state, the conductor seal system 100 set will substantially hold pressure in the annulus up-hole of the packer seal 54. Additionally, the sealing and gripping is pressure energized in that pressure applied up-hole of the packer seal 54 tends to drive the slip assembly 64 and packer seal 54 into stronger engagement with the wall of the wellbore 12. Because the interior of main body 24 is sealed by the upper connector 26, the wellbore 12 is plugged. In other words, no substantial flow (or pressure) may pass through the annulus between the working string 14 and the wall of the wellbore 12 or through the interior of the working string 14. However, at any time (before, during and/or after setting the packer seal 54), electronic current may be transmitted along the internal conductor 22 to the downhole tools 16.

Once set, if it is desired to release the conductor seal system 100, pressure is substantially equalized across the packer seal 54. In one instance, pressure can be equalized by pulling in the up-hole direction on the inner body 27 via working string 14 to extend the inner body 27 from the main body 24, withdraw chevron seals 45 from sealing engagement, and enable communication of flow through the main body to ports 35. Pulling the inner body 27 in the up-hole direction causes the lugs 76 to move into the indexing receptacles 84. The indexing receptacles 84 index the lugs 76 into alignment with the lockout receptacles 82 and up-hole movement disengages the slip assembly 64 and packer seal 54 from engagement with the wellbore 12. Thereafter, the conductor seal system 100 may be withdrawn from the wellbore 12 or repositioned and set again. If repositioned, the conductor seal system 100 is set by moving the conductor seal system 100 up-hole (if not moved up-hole while positioning) to move the lugs 76 into the indexing receptacles 84. The indexing receptacles 84 index the lugs into alignment with the set receptacles 80, and further movement of the conductor seal system 100 downhole actuates the slip assembly 64 into gripping engagement and the packer seal 54 into substantially sealing engagement with the wall of the wellbore 12. The operations of setting and re-setting the conductor seal system 100 can be repeated until it is desired to remove the conductor seal system 100 from the wellbore 12. As noted above, at any time (before, during or after setting the packer seal 54), electric current may be transmitted along the electrical conductor and intermediate conductor 30 to the downhole tools 16.

Figure 6:
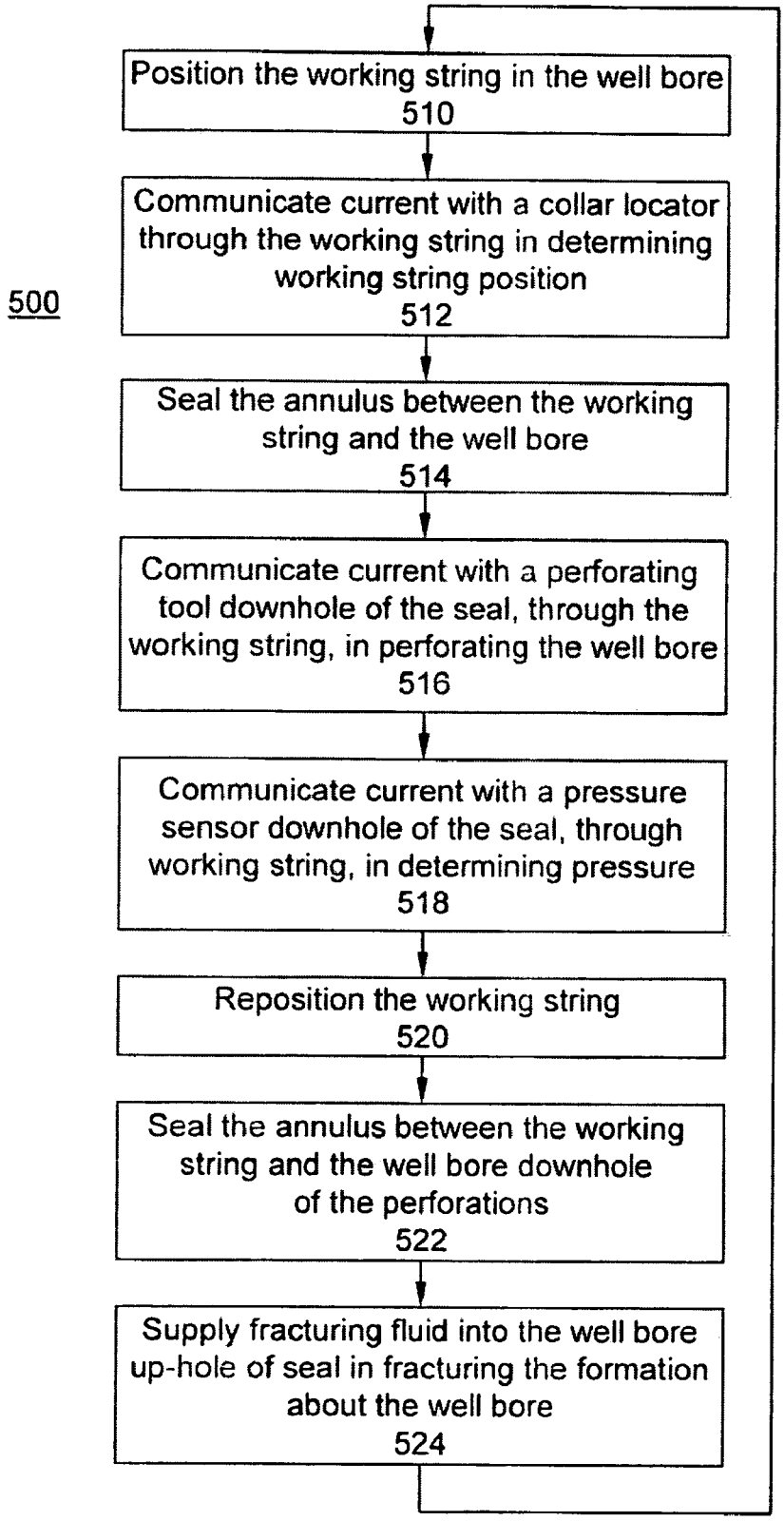
FIG. 6 is a flow diagram of an illustrative method of perforating and fracturing a wellbore in accordance with the concepts described herein.

An illustrative perforating and fracturing method 500 will now be described with reference to FIG. 6. At operation 510, a working string is positioned in the wellbore. At operation 512, power and/or a signal is communicated with a collar locator of the working string in determining the working string position. The communication through the working string. For example, the communication can be on a conductor in the interior of the working string. The communication can be through multiple elements of the working string, including a conductor seal system as described above, if provided. In one instance, the working string may be positioned with a perforating tool thereof aligned at a location of desired perforations. In most instances, the operations 510 and 512 will be performed concurrently, i.e. the collar locator will be used in positioning the working string.

At operation 514 the annulus between the working string and the wellbore is sealed. In one instance, operation 514 may be performed with a conductor seal system similar to that described above. Sealing the annulus between the working string and the wellbore isolates a portion of the wellbore up-hole from the seal from pressure in a portion of the wellbore downhole from the seal.

At operation 516, power and/or a signal is communicated with a perforating tool downhole of the seal in perforating the wellbore. The communication is through the working string. As above, for example, the communication can be on a conductor in the interior of the working string and through multiple elements of the working string, including a conductor seal system as described above, if provided. In one instance, the perforating tool is actuated by the power and/or signal to perforate the wall of the wellbore at the desired location. Of note, operation 514 may be omitted or performed after operate 516, such that the perforating tool is operated without sealing the annulus between the working string and the wellbore.

At operation 518 power and/or a signal is communicated with a pressure sensor downhole of the seal in determining the pressure of the wellbore. The communication is through the working string. As above, for example, the communication can be on a conductor in the interior of the working string and through multiple elements of the working string, including a conductor seal system as described above, if provided. In one instance, the pressure sensor outputs a signal indicative of the pressure in the wellbore about the perforations. That signal is communicated through the working string to the surface or an intermediate location. Output from the pressure sensor may be used in evaluating the perforating operations and/or the formation about the wellbore. In some instances, operation 518 can be performed additionally, or alternatively, prior to setting the sealing the wellbore at operation 514 and/or prior to perforating at operation 516. For example, it may be desirable to take pressure readings before and after perforating for comparison in determining the effectiveness of the perforating.

At operation 520, the working string is repositioned along a length of the wellbore. In one instance, the working string may be positioned with a seal thereof, such as in the conductor seal system described above, located in downhole of the perforations.

At operation 522, the annulus between the working string and the wellbore downhole from the perforations is sealed. In one instance, operation 522 may be performed with a conductor seal system as described above. Sealing the annulus between the working string and the wellbore isolates a portion of the wellbore downhole from the perforations from flow and pressure in a portion of the wellbore that includes the perforations.

At operation 524, fracturing fluid is supplied into the annulus up-hole of the seal in fracturing the formation about the wellbore. The fracturing fluid is supplied at high pressure into the wellbore, flows through the perforations and into the formation about the wellbore to form fractures that radiate outward from the wellbore. The fracturing fluid can be supplied down the annulus, through the interior of the working string to exit in the vicinity of the perforations (e.g. by exiting through ports in the conductor seal system and/or other portion of the working string), or both. During this operation, the elements of the working string in the portion of the wellbore downhole of the seal are substantially protected from the fracturing fluids flow and pressure. For example, the collar locator, pressure sensor and/or perforating tool of the working string can be protected from the flow and pressure of the fracturing fluid if located downhole of the seal. In some instances, operation 518 can be performed additionally, or alternatively, after operation 524. For example, pressure readings taken before and after fracturing can be used for comparison in determining the effectiveness of the fracturing.

The operations 510 through 524 can be repeated at one or more additional locations within the wellbore to perforate and fracture the wellbore at these additional locations. If so configured, such as by including a conductor seal system as described above, the working string can be repositioned at one or more additional locations for perforating and fracturing while maintaining the working string in the wellbore (i.e. without removing the working string from the wellbore). In other words, multiple locations along a length of the wellbore can be perforated and fractured in a single trip. For example, each time operation 510 is repeated, the working string may be positioned such that a perforating tool thereof is aligned with an additional location desired to be perforated. After the wellbore is perforated and fractured in the desired location or locations, the working string may be withdrawn from the wellbore.

Although the method 500 has been described in a particular order, the operations thereof can be performed in any other order or in no order. Additionally, one or more of the operations may be omitted, modified, repeated or other operations may be included. For example, in some instances the pressure readings (operation 518) may be omitted.

A number of embodiments of the invention have been described. Nevertheless, it will be understood that various modifications may be made without departing from the spirit and scope of the invention. Accordingly, other embodiments are within the scope of the following claims.

What is claimed is:

1. A device for inserting in a wellbore, comprising:

a main body adapted to couple between a first element of a working string and a second element of the working string, the main body comprising an internal passageway; and an inner body moveable within the main body between a first position and a second position, the inner body adapted to provide fluid communication through the internal passageway in the first position and to prevent fluid communication through the internal passageway in the second position;

a seal about the main body adapted to substantially sealingly engage a wall of the wellbore; and a conductor carried by the main body, wherein the conductor is adapted to communicate at least one of electrical current or a light signal between an interior of the first element and the second element.

2. The device of claim 1 wherein the conductor is adapted to communicate while the seal is substantially sealingly engaging the wall of the wellbore.

3. The device of claim 1 wherein the conductor is adapted to communicate while the seal is out of sealing engagement with the wall of the wellbore.

4. The device of claim 1 wherein the conductor is adapted to communicate to an interior of the second element.

5. The device of claim 1 wherein the seal is actuable to substantially sealingly engage the wall of the wellbore by moving the working string in the wellbore.

6. The device of claim 1 wherein the seal is repeatably actuable between substantially sealingly engaging and not substantially sealingly engaging the wall of the wellbore while the device is downhole.

7. The device of claim 1 further comprising a gripping member actuable into gripping engagement with the wall of the wellbore.

8. The device of claim 1 wherein the second element comprises a wellbore perforating device.

9. The device of claim 8 wherein the device is adapted to be inserted into the wellbore with the wellbore perforating device downhole of the first element.

10. The device of claim 8 further comprising a collar locator, and wherein the conductor communicates with the collar locator.

11. The device of claim 1 wherein the main body and seal are adapted to cooperate to substantially plug the wellbore.

12. The device of claim 1 wherein the electrical current comprises a signal.

13. The device of claim 1 wherein the working string comprises coiled tubing.

14. A method of wellbore operations, comprising:

substantially isolating a first portion of a wellbore from pressure in a second portion of the wellbore using a working string;

selectively actuating a seal within an interior passageway of the working string between a first element of the working string and a second element of the working string between one of an open condition providing fluid communication through the interior passageway or a closed condition preventing fluid communication through the passageway; and communicating at least one of an electrical current or a light signal between an interior of the first element and the second element, wherein the first element resides in the first portion and the second element resides in the second portion.

15. The method of claim 14 wherein the second element comprises a wellbore perforating tool, and communicating comprises actuating the perforating tool to form a perforation in a wall of the wellbore.

16. The method of claim 15 further comprising while maintaining the working string in the wellbore, substantially isolating a portion of the wellbore downhole of the perforation from pressure in a portion of the wellbore with the perforation.

17. The method of claim 16 further comprising while maintaining the working string in the wellbore:

repositioning the working string to a different location along a length of the wellbore; actuating the perforating tool to form a second perforation in the wall of the wellbore at the different location; and isolating a portion of the wellbore downhole of the second perforation from pressure in a portion of the wellbore with the second perforation.

18. The method of claim 14 wherein the working string includes a collar locator and further comprising communicating between the collar locator and the first element.

19. The method of claim 14 further comprising communicating from a terranean surface to the interior of the first element substantially entirely through an interior of the working string.

20. The method of claim 14 wherein the working string comprises coiled tubing.

21. A method, comprising:

positioning a working string in a wellbore;

substantially sealing an annulus between the working string and the wellbore;

selectively actuating a seal within an interior passageway of the working string between one of an open condition providing fluid communication through the interior passageway between a location above the location of sealing and a location below the location of sealing or a closed condition preventing fluid communication through the passageway between the location above the location of sealing and the location below the location of sealing; and communicating at least one of an electrical current or a light signal through the working string between the location above the location of sealing and the location below the location of sealing.

22. The method of claim 21 wherein communicating comprises actuating a perforating tool to form perforations in a wall of the wellbore.

23. The method of claim 22 wherein the location of sealing is on a first side of the perforations and the method further comprises:

substantially sealing an annulus between the working string and the wellbore on a second side of the perforations; and applying a fracturing fluid into the annulus about the perforations.

24. The method of claim 22 further comprising:

repositioning the working string along a length of the wellbore while maintaining the working string in the wellbore;

substantially sealing an annulus between the working string and the wellbore at another location of sealing; and communicating to actuate the perforating tool to form perforations in a wall of the wellbore.

25. The method of claim 21 wherein communicating comprises communicating a signal from a collar locator.

* * * * *